US008776912B2

(12) United States Patent
Makkar et al.

(10) Patent No.: US 8,776,912 B2
(45) Date of Patent: Jul. 15, 2014

(54) SECONDARY CUTTING STRUCTURE

(75) Inventors: Navish Makkar, Houston, TX (US); Dwayne P. Terracina, Spring, TX (US)

(73) Assignee: Smith International, Inc., Houston, TX (US)

( * ) Notice: Subject to any disclaimer, the term of this patent is extended or adjusted under 35 U.S.C. 154(b) by 341 days.

(21) Appl. No.: 12/767,575

(22) Filed: Apr. 26, 2010

(65) Prior Publication Data

US 2010/0276201 A1 Nov. 4, 2010

Related U.S. Application Data

(60) Provisional application No. 61/174,854, filed on May 1, 2009.

(51) Int. Cl.

| | |
|---|---|
| ***E21B 7/00*** | (2006.01) |
| ***E21B 10/32*** | (2006.01) |
| ***E21B 7/28*** | (2006.01) |
| ***E21B 10/46*** | (2006.01) |

(52) U.S. Cl.

CPC ..... *E21B 10/32* (2013.01); *E21B 10/322* (2013.01); *E21B 7/28* (2013.01); *E21B 10/46* (2013.01)

USPC ..... 175/57; 175/263

(58) Field of Classification Search

USPC ..... 175/57, 263, 267, 273; 29/592

See application file for complete search history.

(56) References Cited

U.S. PATENT DOCUMENTS

| | | | | |
|---|---|---|---|---|
| 2,028,910 | A * | 1/1936 | MacClatchie | 175/398 |
| 2,846,193 | A * | 8/1958 | Chadderdon | 166/55.7 |
| 2,859,943 | A * | 11/1958 | Chadderdon | 166/55.8 |
| 3,224,507 | A | 12/1965 | Cordary et al. | |
| 3,237,705 | A * | 3/1966 | Williams, Jr. | 175/406 |
| 3,425,500 | A | 2/1969 | Fuchs | |
| 4,055,226 | A | 10/1977 | Weber | |
| 5,899,268 | A * | 5/1999 | Lynde et al. | 166/55.6 |
| 6,732,817 | B2 * | 5/2004 | Dewey et al. | 175/57 |

(Continued)

FOREIGN PATENT DOCUMENTS

| | | |
|---|---|---|
| GB | 2423546 A | 8/2006 |
| GB | 2453663 A | 4/2009 |

OTHER PUBLICATIONS

Official Action issued in corresponding Eurasian Application No. 201070985; Dated Nov. 18, 2011 (3 pages).

(Continued)

*Primary Examiner* — Kenneth L Thompson
*Assistant Examiner* — Michael Wills, III
(74) *Attorney, Agent, or Firm* — Osha Liang LLP

(57) ABSTRACT

In one aspect, embodiments disclosed herein relate to a secondary cutting structure for use in a drilling assembly, the second cutting structure including a tubular body and a cutter block, extendable from the tubular body, the block including at least three rows of cutting elements. In another aspect, embodiments disclosed herein relate to drilling a borehole, the method including disposing a drilling tool assembly in the borehole, wherein the drilling tool assembly includes a primary cutting structure and a secondary cutting structure, and wherein the secondary cutting structure ahs a cutter block having at least three rows of cutting elements. The method also includes actuating the primary cutting structure, drilling a first portion of the borehole with the primary cutting structure, actuating the secondary cutting structure, and drilling a second portion of the borehole with both the primary and secondary cutting structures.

18 Claims, 8 Drawing Sheets

(56) References Cited

U.S. PATENT DOCUMENTS

| | | | | |
|---|---|---|---|---|
| 6,920,944 | B2 | 7/2005 | Eppink et al. | |
| 7,314,099 | B2 | 1/2008 | Dewey et al. | |
| 7,493,971 | B2 * | 2/2009 | Nevlud et al. | 175/266 |
| 7,681,666 | B2 * | 3/2010 | Radford et al. | 175/267 |
| 7,757,787 | B2 * | 7/2010 | Mackay et al. | 175/269 |
| 7,770,664 | B2 * | 8/2010 | Laird et al. | 175/57 |
| 7,963,348 | B2 * | 6/2011 | Laird et al. | 175/263 |
| 2005/0145417 | A1 * | 7/2005 | Radford et al. | 175/57 |
| 2005/0241856 | A1 * | 11/2005 | Lassoie et al. | 175/57 |
| 2005/0274546 | A1 * | 12/2005 | Fanuel et al. | 175/57 |
| 2006/0113113 | A1 * | 6/2006 | Underwood et al. | 175/61 |
| 2007/0089912 | A1 * | 4/2007 | Eddison et al. | 175/269 |
| 2008/0105465 | A1 * | 5/2008 | Radford et al. | 175/57 |
| 2008/0128175 | A1 * | 6/2008 | Radford et al. | 175/269 |
| 2008/0251295 | A1 * | 10/2008 | Lassoie et al. | 175/57 |
| 2010/0018779 | A1 | 1/2010 | Makkar et al. | |

OTHER PUBLICATIONS

International Search Report issued in corresponding International Application No. PCT/US2010/032664; Dated Jan. 24, 2011 (5 pages).

Written Opinion issued in corresponding International Application No. PCT/US2010/032664; Dated Jan. 24, 2011 (4 pages).

* cited by examiner

SECONDARY CUTTING STRUCTURE

CROSS-REFERENCE TO RELATED APPLICATIONS

This application, pursuant to 35 U.S.C. §119(e) claims priority to U.S. Provisional Application Ser. No. 61/174,854, filed May 1, 2009. That application is incorporated by reference in its entirety.

BACKGROUND

1. Field of the Disclosure

Embodiments disclosed herein relate generally to secondary cutting structures for use on drilling tool assemblies. More specifically, embodiments disclosed herein relate to secondary cutting structures having a plurality of cutting element rows disposed on cutter blocks. More specifically still, embodiments disclosed herein relate to secondary cutting structures having more than two cutting element rows disposed on cutter blocks.

2. Background Art

FIG. 1A shows one example of a conventional drilling system for drilling an earth formation. The drilling system includes a drilling rig 10 used to turn a drilling tool assembly 12 that extends downward into a well bore 14. The drilling tool assembly 12 includes a drilling string 16, and a bottom-hole assembly (BHA) 18, which is attached to the distal end of the drill string 16. The "distal end" of the drill string is the end furthest from the drilling rig.

The drill string 16 includes several joints of drill pipe 16*a* connected end to end through tool joints 16*b*. The drill string 16 is used to transmit drilling fluid (through its hollow core) and to transmit rotational power from the drill rig 10 to the BHA 18. In some cases the drill string 16 further includes additional components such as subs, pup joints, etc.

The BHA 18 includes at least a drill bit 20. Typical BHA's may also include additional components attached between the drill string 16 and the drill bit 20. Examples of additional BHA components include drill collars, stabilizers, measurement-while-drilling (MWD) tools, logging-while-drilling (LWD) tools, subs, hole enlargement devices (e.g., hole openers and reamers), jars, accelerators, thrusters, downhole motors, and rotary steerable systems. In certain BHA designs, the BHA may include a drill bit 20 or at least one secondary cutting structure or both.

In general, drilling tool assemblies 12 may include other drilling components and accessories, such as special valves, kelly cocks, blowout preventers, and safety valves. Additional components included in a drilling tool assembly 12 may be considered a part of the drill string 16 or a part of the BHA 18 depending on their locations in the drilling tool assembly 12.

The drill bit 20 in the BHA 18 may be any type of drill bit suitable for drilling earth formation. Two common types of drill bits used for drilling earth formations are fixed-cutter (or fixed-head) bits and roller cone bits.

In the drilling of oil and gas wells, concentric casing strings are installed and cemented in the borehole as drilling progresses to increasing depths. Each new casing string is supported within the previously installed casing string, thereby limiting the annular area available for the cementing operation. Further, as successively smaller diameter casing strings are suspended, the flow area for the production of oil and gas is reduced. Therefore, to increase the annular space for the cementing operation, and to increase the production flow area, it is often desirable to enlarge the borehole below the terminal end of the previously cased borehole. By enlarging the borehole, a larger annular area is provided for subsequently installing and cementing a larger casing string than would have been possible otherwise. Accordingly, by enlarging the borehole below the previously cased borehole, the bottom of the formation can be reached with comparatively larger diameter casing, thereby providing more flow area for the production of oil and gas.

Various methods have been devised for passing a drilling assembly through an existing cased borehole and enlarging the borehole below the casing. One such method is the use of an underreamer, which has basically two operative states—a closed or collapsed state, where the diameter of the tool is sufficiently small to allow the tool to pass through the existing cased borehole, and an open or partly expanded state, where one or more arms with cutters on the ends thereof extend from the body of the tool. In this latter position, the underreamer enlarges the borehole diameter as the tool is rotated and lowered in the borehole.

A "drilling type" underreamer is typically used in conjunction with a conventional pilot drill bit positioned below or downstream of the underreamer. The pilot bit can drill the borehole at the same time as the underreamer enlarges the borehole formed by the bit. Underreamers of this type usually have hinged arms with roller cone cutters attached thereto. Most of the prior art underreamers use swing out cutter arms that are pivoted at an end opposite the cutting end of the cutting arms, and the cutter arms are actuated by mechanical or hydraulic forces acting on the arms to extend or retract them. Typical examples of these types of underreamers are found in U.S. Pat. Nos. 3,224,507; 3,425,500 and 4,055,226. In some designs, these pivoted arms tend to break during the drilling operation and must be removed or "fished" out of the borehole before the drilling operation can continue. The traditional underreamer tool typically has rotary cutter pocket recesses formed in the body for storing the retracted arms and roller cone cutters when the tool is in a closed state. The pocket recesses form large cavities in the underreamer body, which requires the removal of the structural metal forming the body, thereby compromising the strength and the hydraulic capacity of the underreamer. Accordingly, these prior art underreamers may not be capable of underreaming harder rock formations, or may have unacceptably slow rates of penetration, and they are not optimized for the high fluid flow rates required. The pocket recesses also tend to fill with debris from the drilling operation, which hinders collapsing of the arms. If the arms do not fully collapse, the drill string may easily hang up in the borehole when an attempt is made to remove the string from the borehole.

Recently, expandable underreamers having arms with blades that carry cutting elements have found increased use. Expandable underreamers allow a drilling operator to run the underreamer to a desired depth within a borehole, actuate the underreamer from a collapsed position to an expanded position, and enlarge a borehole to a desired diameter. Cutting elements of expandable underreamers may allow for underreaming, stabilizing, or backreaming, depending on the position and orientation of the cutting elements on the blades. Such underreaming may thereby enlarge a borehole by 15-40%, or greater, depending on the application and the specific underreamer design.

Typically, expandable underreamer design includes placing two blades in groups, referred to as a block, around a tubular body of the tool. A first blade, referred to as a leading blade absorbs a majority of the load, the leading load, as the tool contacts formation. A second blade, referred to as a trailing blade, and positioned rotationally behind the leading blade on the tubular body then absorbs a trailing load, which is less than the leading load. Thus, the cutting elements of the leading blade traditionally bear a majority of the load, while cutting elements of the trailing blade only absorb a majority of the load after failure of the cutting elements of the leading blade. Such design principles, resulting in unbalanced load conditions on adjacent blades, often result in premature failure of cutting elements, blades, and subsequently, the underreamer.

Accordingly, there exists a need for apparatuses and methods of designing secondary cutting structures having unique cutting element, blade, and block design.

SUMMARY OF THE DISCLOSURE

In one aspect, embodiments disclosed herein relate to a secondary cutting structure for use in a drilling assembly, the second cutting structure including a tubular body and a cutter block, extendable from the tubular body, the block including at least three rows of cutting elements.

In another aspect, embodiments disclosed herein relate to drilling a borehole, the method including disposing a drilling tool assembly in the borehole, wherein the drilling tool assembly includes a primary cutting structure and a secondary cutting structure, and wherein the secondary cutting structure ahs a cutter block having at least three rows of cutting elements. The method also includes actuating the primary cutting structure, drilling a first portion of the borehole with the primary cutting structure, actuating the secondary cutting structure, and drilling a second portion of the borehole with both the primary and secondary cutting structures.

Other aspects and advantages of the invention will be apparent from the following description and the appended claims.

DETAILED DESCRIPTION

In one aspect, embodiments disclosed herein relate generally to secondary cutting structures for use on drilling tool assemblies. More specifically, embodiments disclosed herein relate to secondary cutting structures having a plurality of cutting element rows disposed on cutter blocks. More specifically still, embodiments disclosed herein relate to secondary cutting structures having more than two cutting element rows disposed on cutter blocks.

Figure 1A:
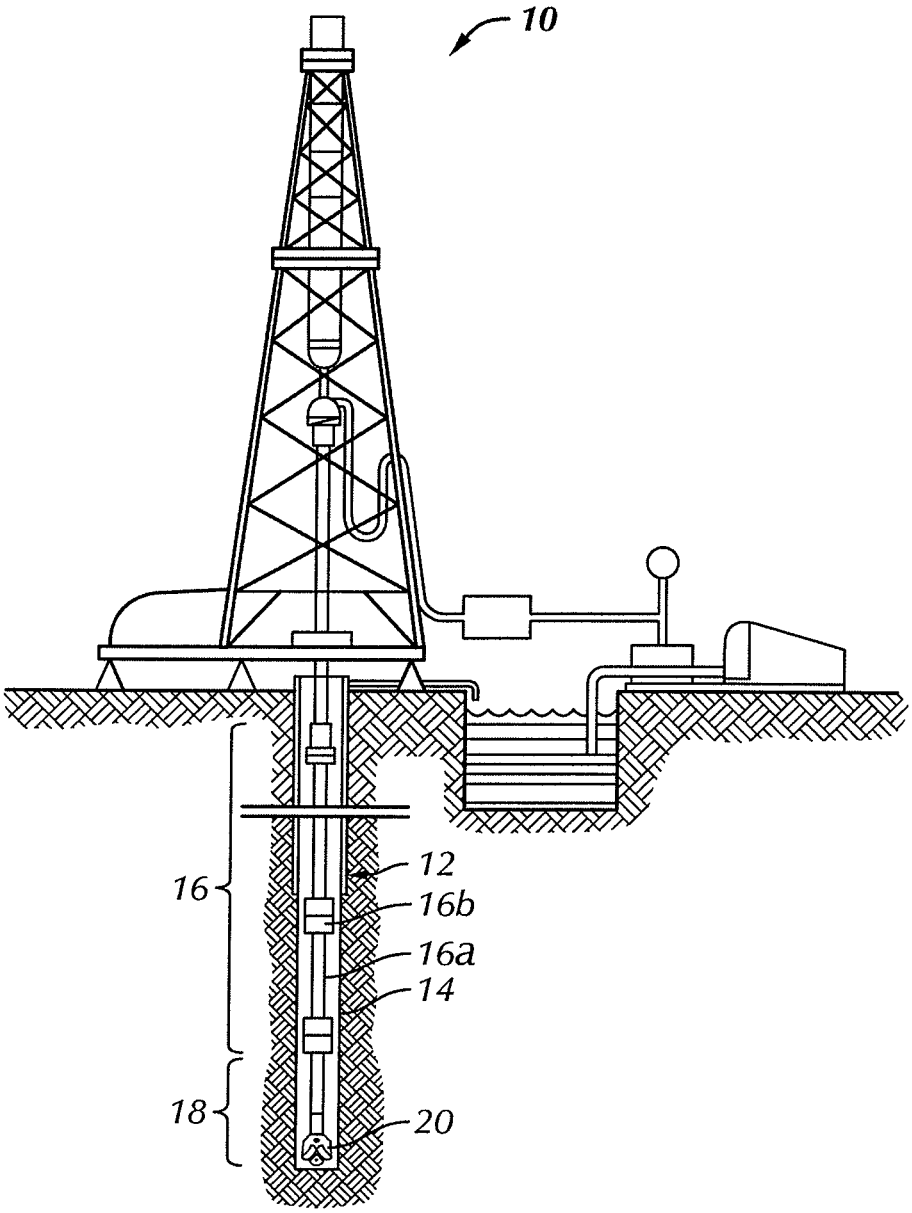
FIG. 1A (PRIOR ART)
FIG. 1A is a schematic representation of a drilling operation.
Figure 1B:
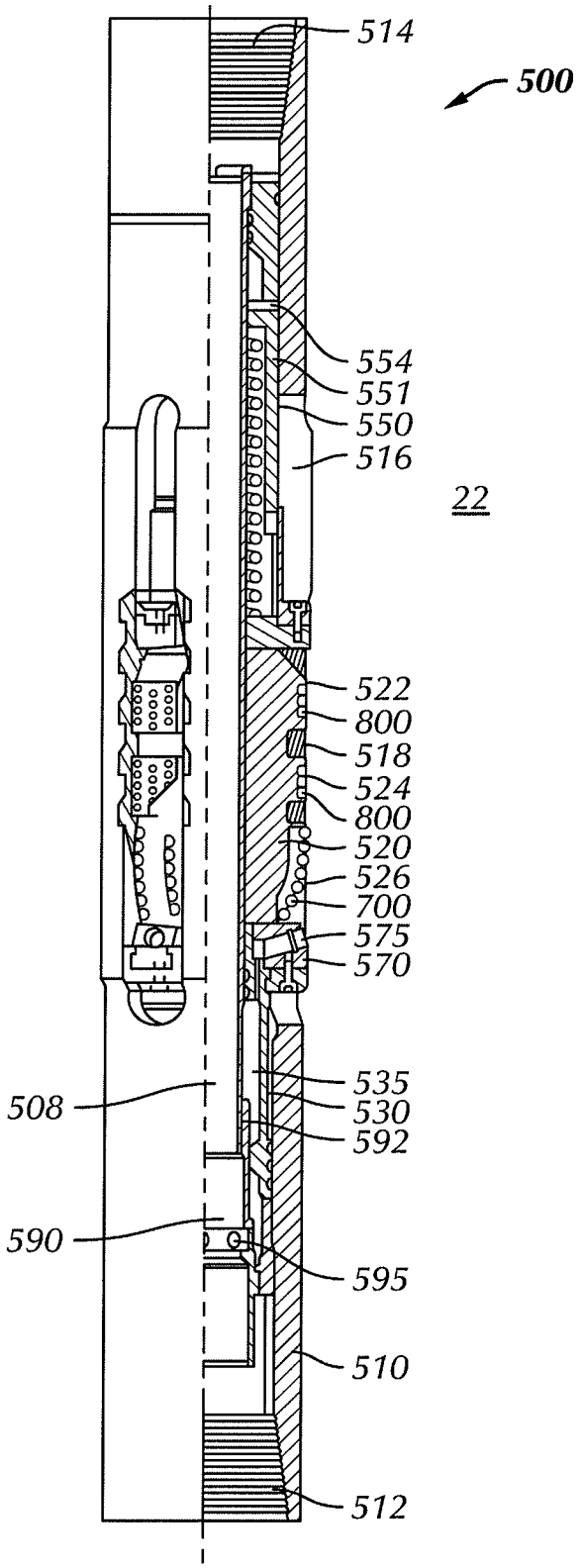
FIGS. 1B and 1C are partial cut away views of an expandable secondary cutting structure.
Figure 1C:
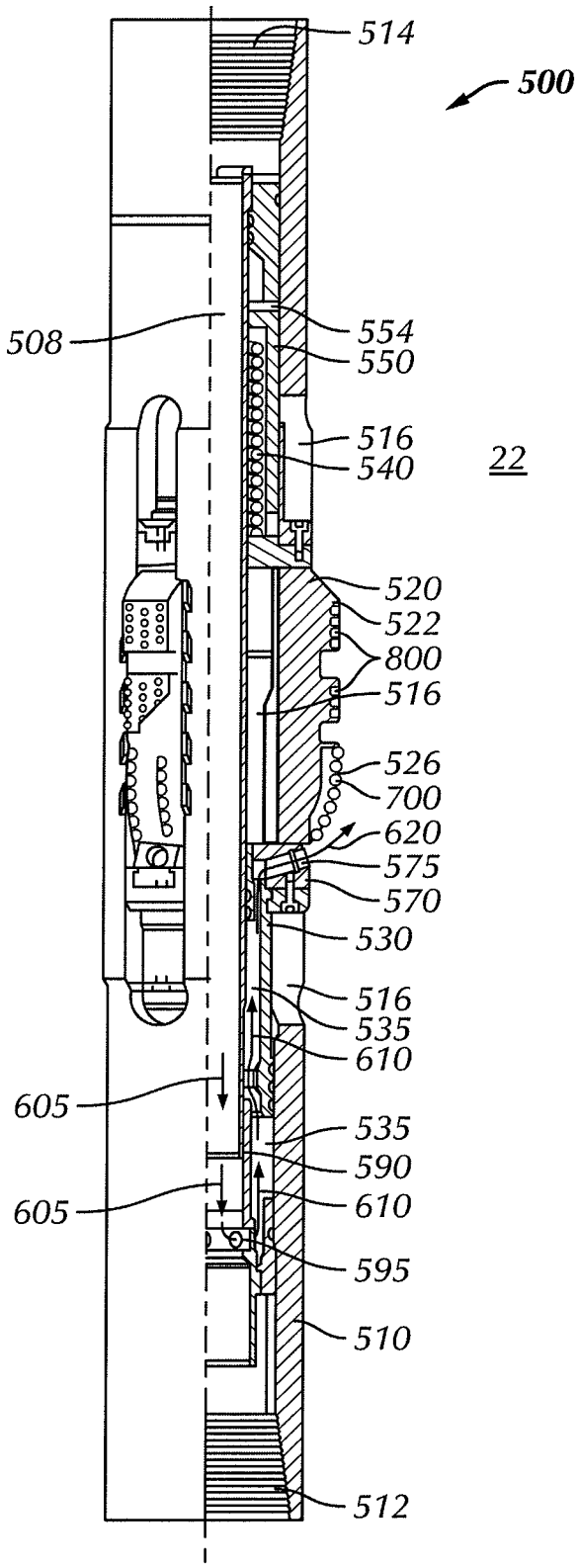

Referring now to FIGS. 1B and 1C, an expandable tool, which may be used in embodiments of the present disclosure, generally designated as 500, is shown in a collapsed position in FIG. 1B and in an expanded position in FIG. 1C. The expandable tool 500 comprises a generally cylindrical tubular tool body 510 with a flowbore 508 extending therethrough. The tool body 510 includes upper 514 and lower 512 connection portions for connecting the tool 500 into a drilling assembly. In approximately the axial center of the tool body 510, one or more pocket recesses 516 are formed in the body 510 and spaced apart azimuthally around the circumference of the body 510. The one or more recesses 516 accommodate the axial movement of several components of the tool 500 that move up or down within the pocket recesses 516, including one or more moveable, non-pivotable tool arms 520. Each recess 516 stores one moveable arm 520 in the collapsed position.

FIG. 1C depicts the tool 500 with the moveable arms 520 in the maximum expanded position, extending radially outwardly from the body 510. Once the tool 500 is in the borehole, it is only expandable to one position. Therefore, the tool 500 has two operational positions—namely a collapsed position as shown in FIG. 1B and an expanded position as shown in FIG. 1C. However, a spring retainer 550, which is a threaded sleeve, may be adjusted at the surface to limit the full diameter expansion of arms 520. Spring retainer 550 compresses a biasing spring 540 when the tool 500 is collapsed, and the position of the spring retainer 550 determines the amount of expansion of the arms 520. Spring retainer 550 is adjusted by a wrench in a wrench slot 554 that rotates the spring retainer 550 axially downwardly or upwardly with respect to the body 510 at threads 551.

In the expanded position shown in FIG. 1C, the arms 520 will either underream the borehole or stabilize the drilling assembly, depending on the configuration of pads 522, 524 and 526. In FIG. 1C, cutting structures 700 on pads 526 are configured to underream the borehole. Depth of cut limiters (i.e., depth control elements) 800 on pads 522 and 524 provide gauge protection as the underreaming progresses. Hydraulic force causes the arms 520 to expand outwardly to the position shown in FIG. 1C due to the differential pressure of the drilling fluid between the flowbore 508 and the annulus 22.

The drilling fluid flows along path 605, through ports 595 in lower retainer 590, along path 610 into the piston chamber 535. The differential pressure between the fluid in the flowbore 508 and the fluid in the borehole annulus 22 surrounding tool 500 causes the piston 530 to move axially upwardly from the position shown in FIG. 1B to the position shown in FIG. 1C. A small amount of flow can move through the piston chamber 535 and through nozzles 575 to the annulus 22 as the tool 500 starts to expand. As the piston 530 moves axially upwardly in pocket recesses 516, the piston 530 engages the drive ring 570, thereby causing the drive ring 570 to move axially upwardly against the moveable arms 520. The arms 520 will move axially upwardly in pocket recesses 516 and also radially outwardly as the arms 520 travel in channels 518 disposed in the body 510. In the expanded position, the flow continues along paths 605, 610 and out into the annulus 22 through nozzles 575. Because the nozzles 575 are part of the drive ring 570, they move axially with the arms 520. Accordingly, these nozzles 575 are optimally positioned to continuously provide cleaning and cooling to the cutting structures 700 disposed on surface 526 as fluid exits to the annulus 22 along flow path 620.

The underreamer tool 500 may be designed to remain concentrically disposed within the borehole. In particular, tool 500, in one embodiment, preferably includes three extendable arms 520 spaced apart circumferentially at the same axial location on the tool 510. In one embodiment, the circumferential spacing may be approximately 120 degrees apart. This three-arm design provides a full gauge underreaming tool 500 that remains centralized in the borehole. While a three-arm design is illustrated, those of ordinary skill in the art will appreciate that in other embodiments, tool 510 may include different configurations of circumferentially spaced arms, for example, less than three-arms, four-arms, five-arms, or more than five-arm designs. Thus, in specific embodiments, the circumferential spacing of the arms may vary from the 120-degree spacing illustrated herein. For example, in alternate embodiments, the circumferential spacing may be 90 degrees, 60 degrees, or be spaced in non-equal increments. Accordingly, the secondary cutting structure designs disclosed herein may be used with any secondary cutting structure tools known in the art.

Figure 2A:
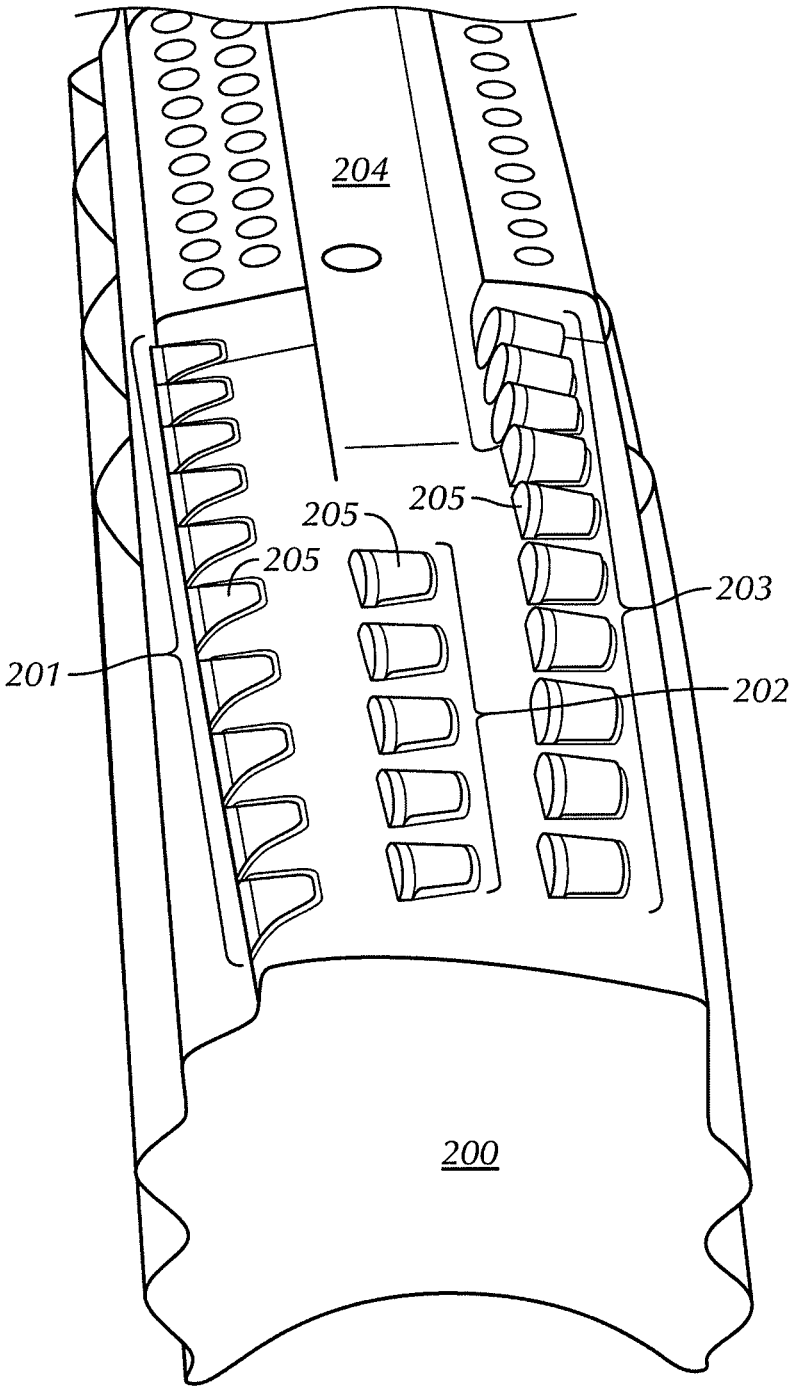
FIG. 2A is an elevated end view of a secondary cutting structure according to embodiments of the present disclosure.
Figure 2B:
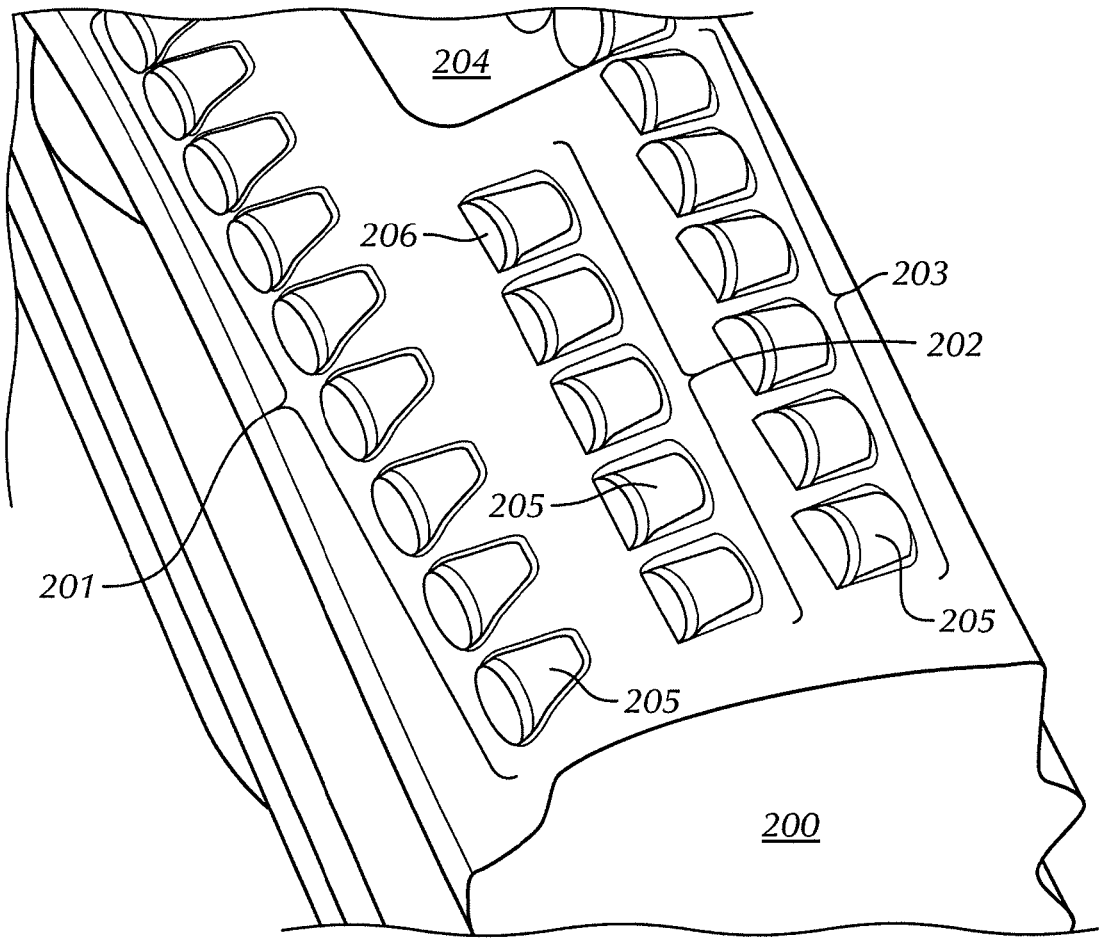
FIG. 2B is an isometric close perspective view of a secondary cutting structure according to embodiments of the present disclosure.

Referring to FIGS. 2A and 2B, an elevated end view and an isometric close perspective view of a cutter block 200 according to embodiments of the present disclosure is shown. In this embodiment, cutter block 200 includes a first row 201 of cutting elements 205, a second row 202 of cutting elements 205, and a third row 203 of cutting elements 205. The rows 201, 202, 203 are aligned along a longitudinal length of cutter block 200. Cutter block 200 also includes a flow channel 204, which extends longitudinally between at least first and third rows 201 and 203.

As illustrated, second row 202 is located on cutter block 200 between first row 201 and third row 203. In certain embodiments, second row 202 is configured to actively engage formation while drilling. However, in alternate embodiments, second row 202 may be a passive row, and as such, may only engage formation after first row 201 experiences sufficient wear so that cutting elements 205 of second row 202 contact formation. In still other embodiments, first and second rows 201 and 202 may be active rows, such that both first and second rows 201 and 202 initially engage formation. In such an embodiment, third row 203 may be a passive row, and as such, only engage formation after either first or second rows 201 and/or 202 experience sufficient wear to allow cutting elements 205 of third row 203 to engage formation.

The above embodiments may thereby allow one or more of first, second, and third rows 201, 202, and/or 203 to define either active or passive rows. As such, one or more of first, second, or third rows 201, 202, or 203 may either initially contact formation, or may contact formation upon sufficient wear of one or more of the other rows. In still other embodiments, cutting elements 205 of first, second, and third rows 201, 202, and 203 may be disposed on cutter block 200, such that all cutting elements 205 of rows 201, 202, and 203 are configured to initially contact formation. Such embodiments may thereby allow first, second, and third rows 201, 202, and 203 to be active rows.

Cutting elements 205 may also be disposed in rows 201, 202, and 203 on cutter block 200 such that one or more of rows 201, 202, and 203 includes a redundant row. For example, in certain embodiments, cutting elements 205 of second row 202 may be disposed on cutter block 200 such that the cutting elements 205 occupy the same radial position as corresponding cutting elements 205 on first row 201. Such a configuration thereby provides a redundant cutting elements 205 arrangement, because as cutting elements 205 of first row 201 wear, cutting elements 205 of second row 202 will cut in substantially the same position. In other cutting elements 205 arrangements, third row 203 may provide a redundant cutting element 205 arrangement for second row 202, while in still other embodiments, cutting elements 205 in third row 203 may provide a redundant cutting element 205 arrangement for first for 201.

In a preferred embodiment, each cutting element 205 on cutter block 200 may be disposed in a unique position. A unique position refers to each cutting element 205 occupying a different radial position. Such a configuration may thereby increase formation coverage by the cutting structure during drilling, because each cutting element will occupy a unique location. Additionally, such a configuration may stabilize the cutting structure during drilling by decreasing lateral forces acting on individual cutting elements 205, thereby improving durability of the cutting structure.

As illustrated, first and third rows 201 and 203 may include full rows, while second row 202 includes a partial row. As such, flow channel 204 continues along the longitudinal length of cutter block 200. Flow channel 204 thereby provides a path for cuttings and fluids to flow past cutter block 200, thereby allowing for the evacuation of cuttings, as well as allowing fluid to lubricate and cool cutting elements 205. Flow channel 204 may be a recess formed in cutter block 200, and may continue along either the entire length of cutter block 200, or in other embodiment, along only a portion of cutter block 200. To prevent the flow from being impeded, a design parameter of an inner cutting element 206 in second row 202 may be optimized. As illustrated, inner cutting element 206 is inner with respect to second row 202, and includes the cutting element closest flow channel 204. For example, inner cutting elements 206 may be a different geometry, size, material, or may be oriented uniquely with respect to other cutting elements 205 in second row 202. In particular embodiments, inner cutting element 206 may be offset from other cutting elements 205 in second row 202, such that flow channel 204 continues along the longitudinal length of cutter block 200. In specific embodiments, flow channel 204 may be disposed between first for 201 and second row 202, second row 202 and third row 203, or between first row 201 and third row 203.

Figure 2C:
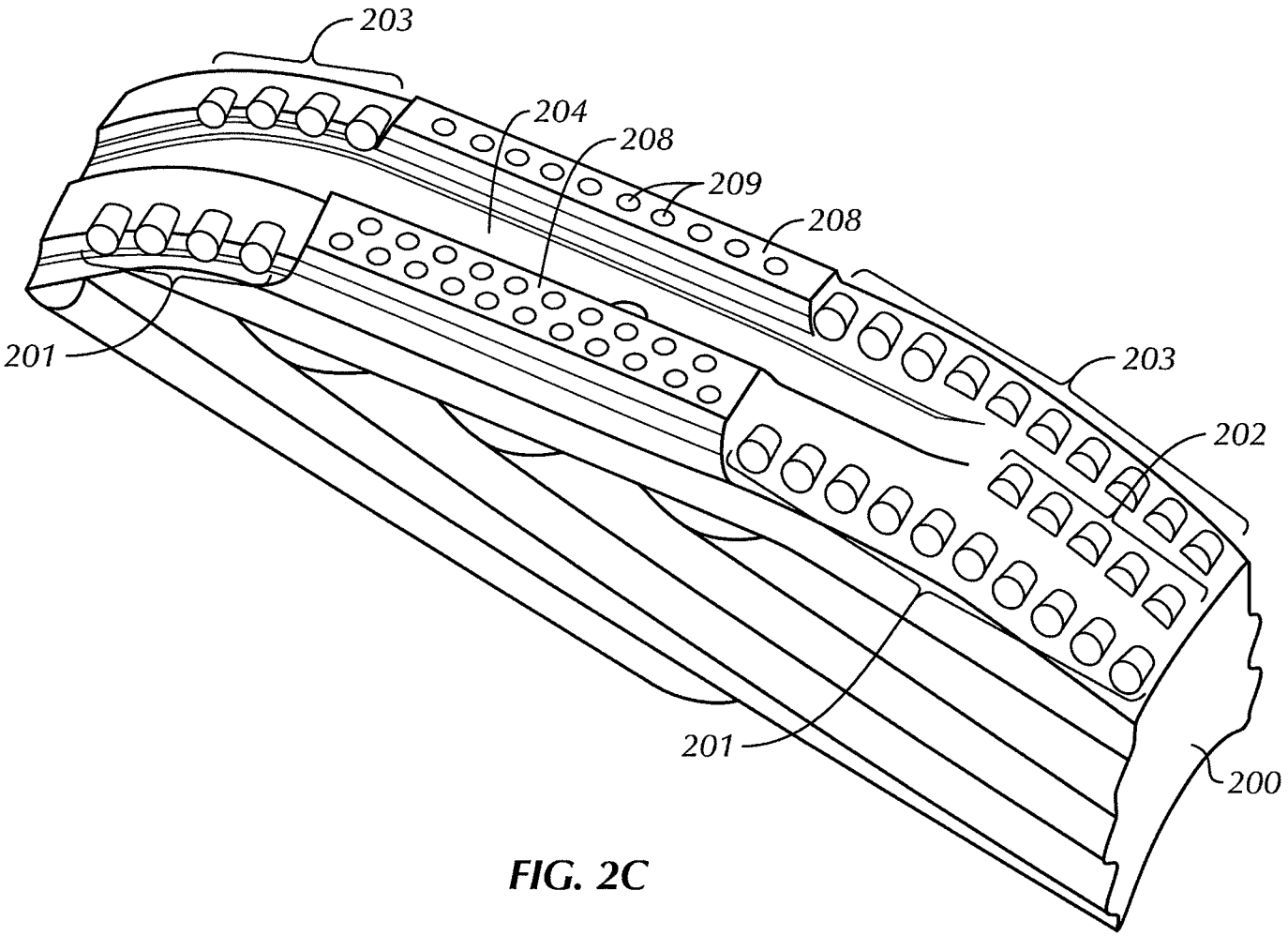
FIG. 2C is an isometric view of a secondary cutting structure according to embodiments of the present disclosure.

Referring to FIG. 2C, an isometric view of a cutter block 200 according to embodiments of the present disclosure is shown. In this embodiments, cutter block 200 includes a first row 201 of cutting elements 205, a second row 202 of cutting elements 205 and a third row 203 of cutting elements 205. As illustrated, second row 202 is a partial row, which only extends a portion of the length of cutter block 200. In contrast, first and third rows 201 and 203 extend, in two portions, with a stabilizer pad 208 therebetween, the length of cutter block 200. Cutter block 200 also includes a flow channel 204, which extends substantially the entire longitudinal length of cutter block 200, and continues between second and third rows 202 and 203 at a distal end of cutter block 200.

As illustrated, stabilizer pad 208 includes a plurality of gauge inserts 209. In other embodiments, cutter block 200 may include additional design features, such as, for example, diamond enhanced inserts, wear compensation inserts, and/or depth of cut limiters. In still other embodiments, second row 202 may extend substantially the entire length of cutter block, as first and third rows 201 and 203 extend in the presently illustrated embodiment.

Those of ordinary skill in the art will appreciate that secondary cutting structure designs as disclosed herein may include modification of individual cutting element design parameters. Examples of cutting element design parameters that may be adjusted may include back rake angles, side rake angles, and cutting elements exposure.

Figure 3:
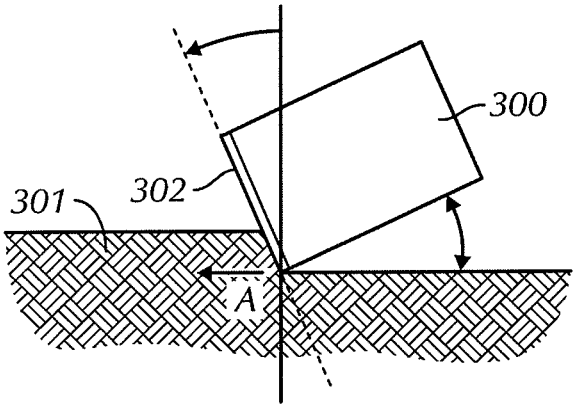
FIG. 3 is a schematic representation of a cutting element cutting formation according to embodiments of the present disclosure.

Referring to FIG. 3, a schematic illustration of a cutting element contacting formation, according to embodiments of the present disclosure, is shown. In this embodiment, cutting element 300 is shown contacting formation 301, as the cutting element 300 moves in direction A. One design element that may be modified in a cutting element arrangement, according to embodiments disclosed herein, includes the back rake angle of individual cutting elements 300. Back rake angle defines the aggressiveness of the cutter, and is defined as the angle between the normal direction of cutting element movement and a cutting element face plane 302. Accordingly, a cutting element 300 having 0° of back rake would be perpendicular to the formation being drilled.

In typical secondary cutting structure designs, large back rake angles (i.e., back rake angles greater than 20°) have been used to reduce cutting element failure by decreasing impact loading. However, in accordance with embodiments disclosed herein, decreasing back rake angle to less than 20°, thereby increasing the aggressiveness of the cut, may increase the stability of the secondary cutting structure. In certain embodiments, the back rake angle of one or more cutting elements may be in a range of about 0° to about 5°, about 5° to about 15°, or other ranges contained therein. Decreasing the back rake angle may actually decrease lateral vibrations experienced by the secondary cutting structure by, among other things, matching the aggressiveness of the secondary cutting structure to the aggressiveness of an associated drill bit or primary cutting structure. Allowing both the primary and the secondary cutting structure to cut formation with a similar aggressiveness may decrease vibrations of the entire drilling tool assembly, thereby increasing the stability of the drilling tool assembly. Examples of various back rake angles that may be used according to embodiments disclosed herein are discussed in co-pending U.S. patent application Ser. No. 12/179,469, assigned to the assignee of the present application, and hereby incorporated by reference herein.

Figure 4:
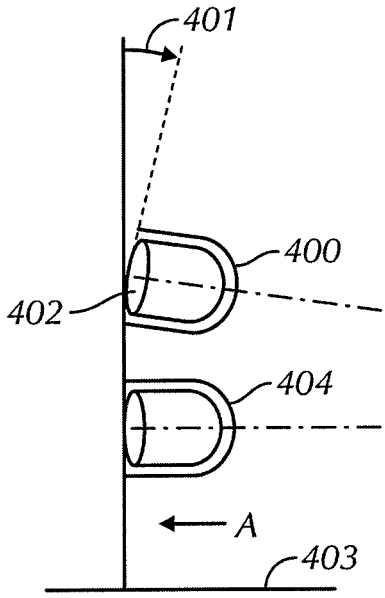
FIG. 4 is a schematic representation of a cutting element cutting formation according to embodiments of the present disclosure.

Referring to FIG. 4, a schematic illustration of a cutting element according to embodiments of the present disclosure is shown. In this embodiment, cutting element 400 is illustrated moving in direction A, and includes an increased side rake angle 401. Side rake angle 401 is the angle between the cutting element face 402 and the radial plane of the secondary cutting structure centerline 403. As such, cutting element 404 is illustrated having 0° of side rake, while cutting element 400 is illustrated having greater than 5° of side rake. In typical secondary cutting structure design, side rake angle 401 is approximately 0°, as indicated by cutting element 404. However, according to embodiments of the present disclosure, side rake angle 401 of one or more of the cutting elements of the secondary cutting structure may have a value of, for example, approximately ±10°. By increasing side rake 401, circumferential cutting forces acting along cutting element edges may be balanced. Balancing the load on individual cutting elements may decrease cutting element fatigue, and thus prevent premature cutting element failure. In certain embodiments, the side rake angle 401 may be increased to ±10°, while in some embodiments, the preferred side rake angle may be ±5°. Those of ordinary skill in the art will appreciate that the specific side rake angle used will depend on other design elements of the specific secondary cutting structure, and as such, only certain cutting elements in a cutting element arrangement may include a side rake angle of greater than 0°. Examples of various side rake angles that may be used according to embodiments disclosed herein are discussed in co-pending U.S. patent application Ser. No. 12/179,469, previously incorporated by reference.

Figure 5:
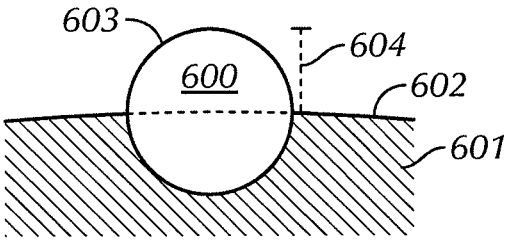
FIG. 5 is a front view of a cutting element disposed on a blade according to embodiments of the present disclosure.
Figure 6:
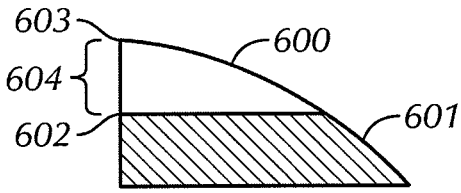
FIG. 6 is a side view of a cutting element disposed on a blade according to embodiments of the present disclosure.

Referring to FIGS. 5 and 6, front and side views of a cutting element according to embodiments of the present disclosure are shown. In addition to the design element modifications discussed above, a cutting element exposure may also be modified according to embodiments of the present disclosure. In this embodiment, cutting element 600 is disposed along a blade 601. Cutting element exposure refers to the distance from an edge of a blade 602 to an edge of an exposed cutting element 603. Thus, the cutting element exposure for cutting element 600 is illustrated by reference character 604. In accordance with embodiments disclosed herein, cutting element exposure may be decreased to half the diameter (i.e., 50% of the diameter of the cutting element) of the cutting element. Such a cutting element exposure may thereby provide for adequate hydraulic flow around the cutting element, thereby promoting the evacuation of cuttings, while still preventing the blade 601 from directly contacting the formation. In other embodiments, cutting element 600 may be exposed 15%, 25%, 35%, or to another exposure less than 50%. Those of ordinary skill in the art will appreciate that cutting element exposure is another design element that may be modified in accordance with the secondary cutting structure designs disclosed herein. Examples of various cutting element exposure values that may be used according to embodiments disclosed herein are discussed in co-pending U.S. patent application Ser. No. 12/179,469, previously incorporated by reference.

In addition to modifying cutting element design parameters, the cutting structure on or between individual cutter blocks may be adjusted. As discussed above, downhole tools including secondary cutting structure may include multiple cutter blocks. For example, in certain embodiments, such downhole tools may include three cutter blocks disposed around the downhole tool in 120° increments. Cutting elements may be disposed on the cutter blocks in particular locations and/or orientations. For example, cutting elements may be arranged in single sets, plural sets, modified plural set, or spiral sets (forward or reverse), and the arrangements may vary across individual cutter blocks. Examples of various cutting element arrangements that may be used according to embodiments disclosed herein are discussed in co-pending U.S. patent application Ser. No. 12/179,469, previously incorporated by reference.

Figure 7A:
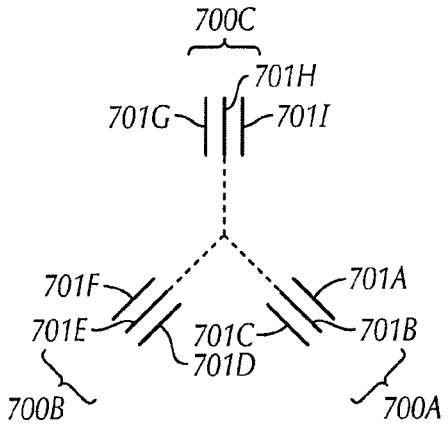
FIGS. 7A-7F are schematic representations of cutting element layouts according to embodiments of the present disclosure.

Referring to FIGS. 7A-7F, various cutter layout options, according to embodiments of the present disclosure, are show. Referring initially to FIG. 7A, a single set arrangement is shown. In a single set arrangement, each cutting element of each block occupies a unique position. Thus, cutter blocks 700A-700C include a unique arrangement of cutting elements. As illustrated, each of cutter blocks 700A-700C include three rows of cutting elements, namely, rows 701A-701I. Thus, first cutter block 700A includes rows 701A-701C, second cutter block 700B includes rows 701D-701F, and third cutter block 700C includes rows 701G-I. Single sets, such as those disclosed in FIG. 7A, may be arranged as spiral or reverse spiral, depending on the location of individual cutting elements on particular blocks.

Figure 7B:
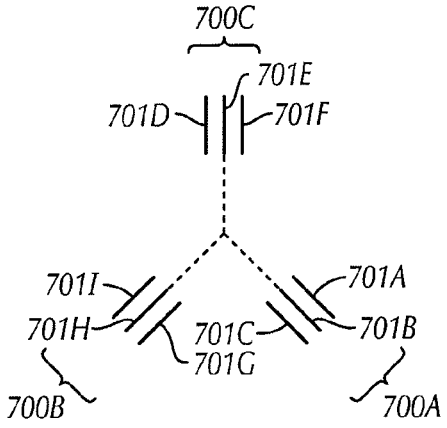

Referring to FIG. 7B, an alternate single set arrangement is shown. In this embodiment, first cutter block 700A includes rows 701A-701C, second cutter block 700B includes rows 701G-701I, and third cutter block 700C includes rows 701D-F. As explained above, embodiments such as these may include either spiral or reverse spiral arrangements, depending on the location of individual cutting elements on particular blocks.

Figure 7C:
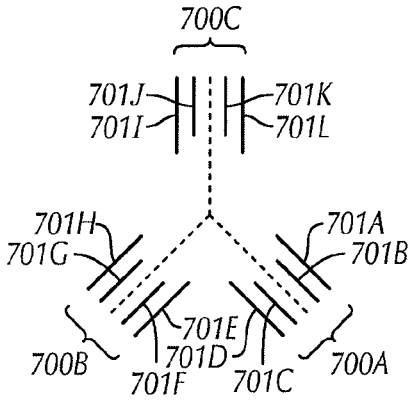
Figure 7D:
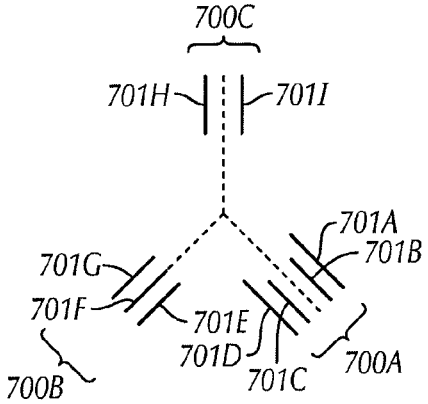

Referring to FIG. 7C, an alternate arrangement of cutting elements, rows, and blocks is illustrated. In this embodiment, first cutter block 700A includes four rows of cutting elements, namely, rows 701A-701D. Second cutter block 700B includes four rows of cutting elements, rows 701E-H, and third cutter block 700C includes four rows of cutting elements, rows 701I-L. Those of ordinary skill in the art will appreciate that cutter blocks 700 in accordance with embodiments disclosed herein may include three, four, or more rows 701 of cutting elements. Referring to FIG. 7D, an alternate arrangement of cutting elements is shown, wherein first cutter block 700A includes four rows 701A-D of cutting elements. Second cutter block 700B includes three rows of cutting elements, rows 701E-701G, and third cutter block 700C includes two rows of cutting elements, rows 701H and 701I. As such, secondary cutting structures may include various numbers of rows of cutting elements depending on particular design considerations.

Figure 7E:
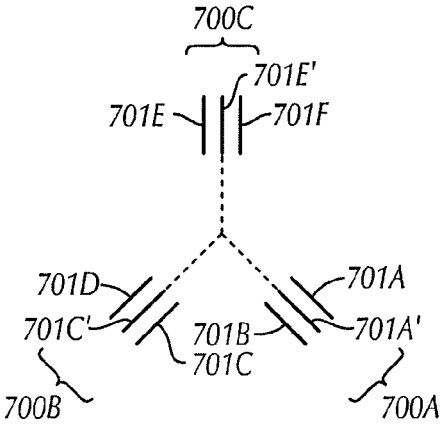

Referring to FIG. 7E, a plural set arrangement of cutting elements, rows, and blocks is illustrated. In this embodiment, first cutter block 700A includes three rows of cutting elements, 701A, 701A', and 701B. Cutting element rows indicated as being prime, for example 701A', 701C', and 701E'. Rows indicated as being prime rows may include redundant cutting structure for corresponding rows 701A, 701C, and 701E. Thus, in the present embodiment, first block 700A includes a primary cutter row 701A and a redundant row 701A'. Similarly, second block 700B includes a primary cutter row 701C and a redundant row 701C', and third block 700C includes a primary cutter row 701E and a redundant row 701E'.

Figure 7F:
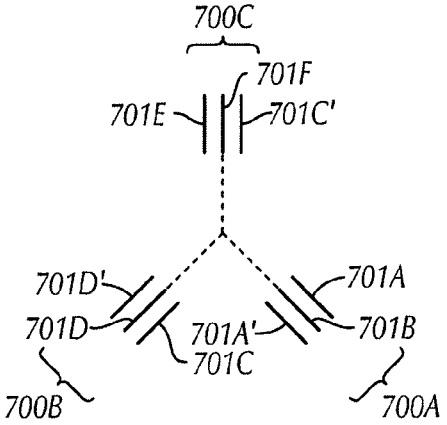

Referring to FIG. 7F, another exemplary plural set arrangement of cutting elements, rows, and blocks is illustrated. In this embodiment, first cutter block 700A includes cutting element rows 701A, 701B, and 701A', wherein 701A' is redundant of row 701A. Similarly, second cutter block 700B includes rows 701C, 701D, and 701D', wherein 701D' is redundant of 701D. As illustrated, the redundant cutting row does not have to be directly behind primary row, as shown in first cutter block 700A, however, in certain designs, the redundant cutting row will be directly behind the primary row, as shown in second cutter block 700B. In still other designs, a redundant row may be located on a different cutter block than the primary row. For example, in this embodiment, row 701C in second cutter block 700B is a primary row, and row 701C' is a redundant row, and is located in third cutter block 701C. Thus, depending on the requirements of a particular cutting operation, the secondary cutting structure design may include various configurations of cutting elements on particular rows and/or blocks. In certain arrangements, such as modified plural sets, one or more design parameters of particular cutting elements may be modified on a particular redundant row. For example, in certain embodiments, row 701A' may be modified such that one or more cutting elements in the row, while being redundant of row 701A, may have a different back rake angle, side rake angle, cutter exposure, etc. As such, the modified plural set may be used in particular secondary cutting designs.

As discussed above, in one embodiment, individual cutting elements may be arranged in rows on cutter blocks such that no two cutting elements occupy the same position, thereby resulting in a unique secondary cutting structure. In other embodiments, cutting elements may be disposed so that particular cutting elements are redundant. In a redundant cutting element arrangement, a second cutting element may be redundant with respect to a first cutting element, and the first and second cutting elements may be disposed on the same cutter block or on different cutter blocks. As such, various arrangements of cutting elements are within the scope of the present disclosure.

In still further embodiments, secondary cutting structure designs may include other various features to facilitate cutting and/or stabilization of the downhole tool during drilling. In certain embodiments, wear compensation inserts, such as diamond enhanced inserts, may be disposed on cutter blocks to help stabilize the downhole tool. In such embodiments, the wear compensation inserts may be disposed directly behind individual cutting elements in one or more of the plurality of rows, while in other embodiments, wear compensation inserts may be disposed offset from individual cutting elements in one or more of the plurality of rows.

In other embodiments, depth of cut limiters may be disposed behind individual cutting elements on one or more of the plurality of rows (e.g., between rows). Depth of cut limiters may include inserts with cutting capacity, such as back up cutters or diamond impregnated inserts with less exposure than primary cutting elements, or diamond enhanced inserts, tungsten carbide inserts, or other inserts that do not have a designated cutting capacity. While depth of cut limiters do not primarily engage formation during drilling, after wear of primary cutting elements, depth of cut limiters may engage the formation to protect the primary cutting elements from increased loads as a result of worn primary cutting elements. Depth of cut limiters are disposed behind primary cutting elements at a selected distance, such that depth of cut limiters may remain unengaged with formation until wear of primary cutting elements occurs.

After depth of cut limiters engage formation, due to wear of primary cutting elements, the load that would normally be placed upon primary cutting elements is redistributed, and per cutter force may be reduced. Because the per cutter force may be reduced, primary cutting elements may resist premature fracturing, thereby increasing the life of the primary cutting elements. Additionally, redistributing cutter forces may balance the overall weight distribution on the secondary cutting structure, thereby increasing the life of the tool. Furthermore, depth of cut limiters may provide dynamic support during wellbore enlargement, such that the per cutter load may be reduced during periods of high vibration, thereby protecting primary cutting elements and/or backup cutting elements (not illustrated). During a period of increased drill string bending and off-centering, depth of cut limiters may contact the wellbore, thereby decreasing lateral vibrations, reducing individual cutter force, and balancing torsional variation, so as to increase durability of the secondary cutting structure and/or individual cutting elements.

In certain embodiments, cutting elements may be disposed in square cutter pockets during manufacturing of the secondary cutting structure, thereby allow for three or more rows of cutting elements to be disposed on a single cutter block. Examples of cutter pockets that may be used according to embodiments of the present disclosure may be found in, for example, co-pending U.S. Provisional Application Ser. No. 61/174,928, published as U.S. Publication No. 2010/0276210, assigned to the assignee of the present disclosure, and hereby incorporated by reference herein.

Advantageously, embodiments of the present disclosure may allow for a secondary cutting structure that results in a balanced load distribution between individual cutting elements and/or cutter blocks. Additionally, the secondary cutting structure disclosed herein may provide for balanced forces along the entire drilling tool assembly by reducing lateral and torsional vibrations.

Also advantageously, in certain designs, the secondary cutting structure disclosed herein may particularly benefit drilling of heterogeneous formation. For example, if a primary cutting structure, such as a drill bit, is drilling a relatively soft formation, and a secondary cutting structure, such as a reamer, is drilling a relatively hard formation, the resultant lateral vibrations may damage one or more of the primary and/or secondary cutting structure. Because embodiments disclosed herein provide for additional rows of cutting elements on the secondary cutting structure, the secondary cutting structure may more effectively drill relatively hard formation while a primary cutting structure is drilling relatively soft formation, thereby decreasing lateral vibrations and preventing damage to either cutting structure. Additional benefits may also be achieved when the primary cutting structure is drilling relatively hard formation and the secondary cutting structure is drilling relatively soft formation.

Advantageously, embodiments disclosed herein may also provide a particular benefit when drilling transitional formations, wherein the mechanical properties vary widely. For example, drilling under pressurized sands and salts can cause excessive stress on cutting elements of a secondary cutting structure. Advantageously, embodiments disclosed herein may provide a more stable drilling environment, thereby resulting in an increased rate of penetration and superior bore hole quality.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A secondary cutting structure for use in a drilling assembly, the secondary cutting structure comprising:

a tubular body;

a cutter block, extendable from the tubular body, the block including at least three rows of cutting elements disposed on a downhole end of the cutter block; and a flow channel extending longitudinally between at least two of the at least three rows of cutting elements, wherein the flow channel is collinear with one of the at least three rows of cutting elements.

2. The secondary cutting structure of claim 1, wherein the secondary cutting structure comprises at least three cutter blocks.

3. The secondary cutting structure of claim 1, wherein at least one of the at least three rows comprises a partial row.

4. The secondary cutting structure of claim 1, wherein the cutting elements are disposed in a unique configuration.

5. The secondary cutting structure of claim 1, wherein the cutting elements are disposed in a plural set configuration.

6. The secondary cutting structure of claim 1, further comprising:

at least one depth of cut limiter.

7. The secondary cutting structure of claim 1, further comprising:

at least one stabilizer pad.

8. The secondary cutting structure of claim 1, wherein at least one of the cutting elements is disposed on the cutter block with a back rake angle of less than 15 degrees.

9. A method of drilling a borehole, the method comprising:

disposing a drilling tool assembly in the borehole, the drilling tool assembly including a primary cutting structure and a secondary cutting structure, the secondary cutting structure having a cutter block with at least three rows of cutting elements disposed on a downhole end of the cutter block, wherein at least one of the at least three rows is a partial row;

actuating the primary cutting structure;

drilling a first portion of the borehole with the primary cutting structure;

actuating the secondary cutting structure; and drilling a second portion of the borehole with both the primary and secondary cutting structures.

10. The method of claim 9, wherein the drilling tool assembly is drilling a heterogeneous formation.

11. A method of manufacturing a cutter block, the method comprising:

forming a cutter block body having at least three rows of cutting element pockets on a downhole end of the cutter block;

forming a flow channel in the cutter block in line with one of the at least three rows of cutting element pockets; and disposing a plurality of cutting elements in the cutting element pockets, such that there are at least three rows of cutting elements disposed on the downhole end of the cutter block.

12. The method of claim 11, wherein at least one of the at least three rows comprises a partial row.

13. The method of claim 11, further comprising:

disposing at least one stabilizer pad on the cutter block.

14. The method of claim 11, wherein the forming the cutter block body further comprises:

forming the cutting elements pocket in a unique configuration.

15. The method of claim 11, wherein the forming the cutter block body further comprises:

forming the cutting element pockets to be substantially square.

16. The method of claim 11, further comprising:

positioning at least one of the plurality of cutting elements with a back rake angle of less than 15 degrees.

17. A secondary cutting structure for use in a drilling assembly, the secondary cutting structure comprising:

a tubular body;

a cutter block extendable from the tubular body, the block including at least three rows of cutting elements disposed on a downhole end of the cutter block, wherein at least one of the at least three rows is a partial row; and a flow channel extending longitudinally between at least two of the three rows of cutting elements.

18. The drilling tool assembly of claim 17, wherein the cutting elements are disposed in a unique configuration.

* * * * *